US010460629B1

(12) United States Patent
Yep Valencia

(10) Patent No.: US 10,460,629 B1
(45) Date of Patent: Oct. 29, 2019

(54) PERPETUAL MONTH DISPLAY CALENDAR

(71) Applicant: Javier Ken-San Yep Valencia, San Jose, CA (US)

(72) Inventor: Javier Ken-San Yep Valencia, San Jose, CA (US)

( * ) Notice: Subject to any disclaimer, the term of this patent is extended or adjusted under 35 U.S.C. 154(b) by 0 days.

(21) Appl. No.: 15/902,812

(22) Filed: Feb. 22, 2018

(51) Int. Cl.

| | |
|---|---|
| ***G09D 3/00*** | (2006.01) |
| ***G09D 3/06*** | (2006.01) |
| ***G09F 7/18*** | (2006.01) |
| ***G09F 15/00*** | (2006.01) |

(52) U.S. Cl.
CPC ..... *G09D 3/06* (2013.01); *G09F 7/18* (2013.01); *G09F 15/0018* (2013.01); *G09F 2007/1856* (2013.01)

(58) Field of Classification Search
CPC ..... G09D 3/06; G09D 3/10; B42D 5/04
USPC ..... 40/107, 109, 110, 118; 283/2; 434/203, 434/304; 446/119
See application file for complete search history.

(56) References Cited

U.S. PATENT DOCUMENTS

| | | | | | |
|---|---|---|---|---|---|
| 1,694,405 | A * | 12/1928 | Troidl | G09B 17/00 | 434/203 |
| 3,579,882 | A * | 5/1971 | Miyahune | G09D 3/02 | 40/107 |
| 4,358,906 | A * | 11/1982 | Reininga | G09D 3/02 | 40/107 |
| 5,657,561 | A * | 8/1997 | Zykov | G09D 3/10 | 40/118 |
| 7,363,735 | B2 * | 4/2008 | Riddle | G09D 3/08 | 283/2 |
| 7,397,731 | B2 * | 7/2008 | Scurlock | G09D 3/04 | 368/28 |

* cited by examiner

*Primary Examiner* — Joanne Silbermann

(57) ABSTRACT

A perpetual month display calendar, consisting of three components: a month/day display loop, a date display loop, and a back cover, configured independently and assembled together to display a full month's information. The desired month is selected by vertically shifting the month/day display loop pieces and positioning the piece of the corresponding month on the top front section. The layout of the dates is selected by horizontally shifting the date display loop pieces, which then embrace the month/day display loop. The back cover is attached to enhance the appeal and functionality of the back of the calendar. The calendar does not comprise small loose individual pieces, allowing its manipulation with no concern of possibly losing one of them.

3 Claims, 13 Drawing Sheets

PERPETUAL MONTH DISPLAY CALENDAR

BACKGROUND OF THE INVENTION

1. Field of the Invention

This invention relates to calendars; specifically, month display calendars, perpetual calendars, calendar design, and calendar construction.

2. Prior Art

One of the most common month display calendars consists of many sequenced sheets bound together, each one displaying one month at a time which is trashed when outdated. However highly customizable, these calendars need to be acquired at the beginning of the year to maximize their value, cannot be reused, and generate constant paper waste. Multiple perpetual calendars have been designed as solutions for these issues, which address different needs through particular designs containing deficiencies as well. For instance, U.S. Pat. No. 7,397,731 B2 to Scurlock Et Al is a type of perpetual calendar that displays the current date, but needs to be updated every day, which the user might find tedious. Additionally, the use of many small pieces creates the risk of rendering the whole calendar useless if only one piece is lost. U.S. Pat. No. 7,363,735 B2 to Riddle Et Al is another type of perpetual calendar that displays unnecessary information, whereas the needed information appears in a reduced space, generating visual noise and possibly distracting the user.

3. Advantages

The present invention has multiple advantages:

a) the totality of the calendar's front surface displays needed information (a full month);
b) it is easy and fast to manipulate;
c) it is enjoyable to manipulate;
d) it only needs to be updated once a month;
e) its assembled components prevent the user from having many loose pieces;
f) it is simple and highly customizable (can be manufactured in a variety of colors, materials, etc.);
g) the back side of the calendar can perform useful functions;

Thus, this invention presents a superior perpetual calendar design due to the improved interaction between its components, which yields not only a more useful monthly perpetual calendar, but also a more enjoyable user experience.

SUMMARY

In accordance with the present invention, a perpetual month display calendar comprises a month/day display loop, a date display loop, and a back cover. The desired month is selected by shifting the month/day display loop pieces and positioning the piece of the corresponding month on the top front section. The layout of the dates is set by shifting the date display loop pieces, which then are expanded to allow the month/day display loop to be inserted. The back cover is then attached and can be adapted to perform different functions.

DRAWINGS—FIGURES

The following figures are shown as a way of illustration of the present invention and not of limitation; therefore, changes and modifications may be made within the scope of the present invention, without departing from its spirit thereof.

Figure 1:
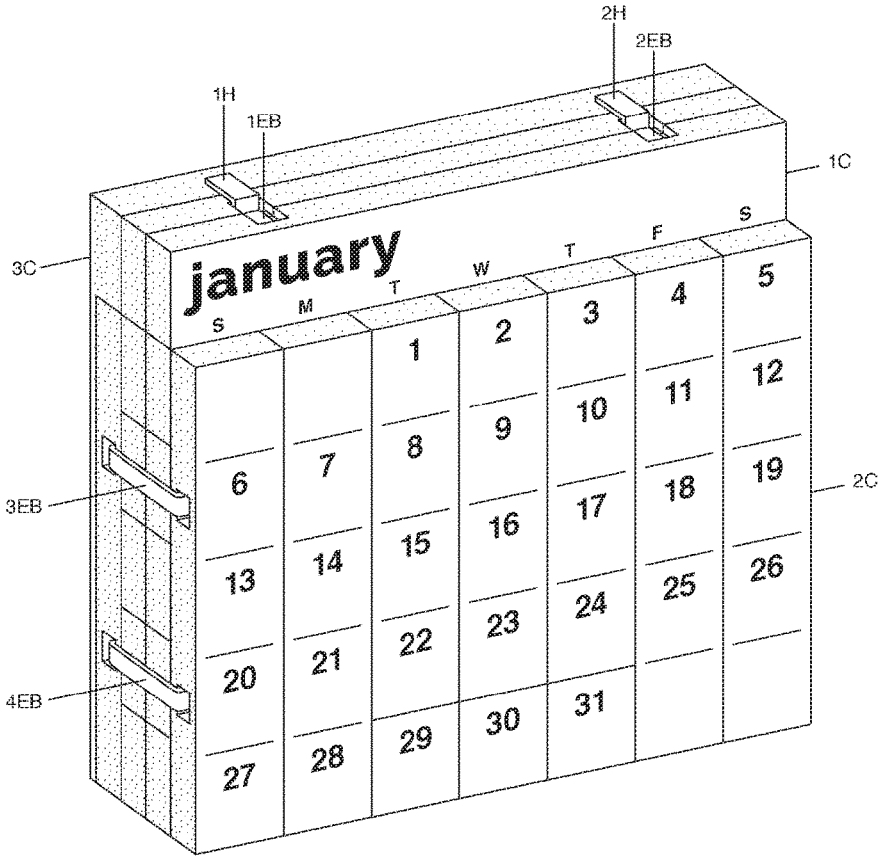

FIG. 1: Calendar assembled with the 3 components (front-perspective view)

Figure 2:
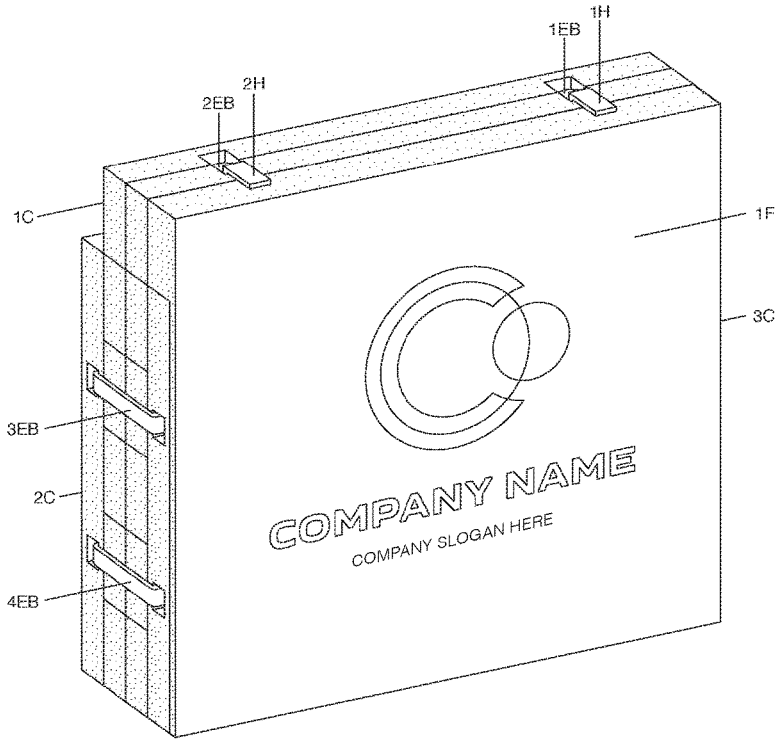

FIG. 2: Calendar assembled with the 3 components, and back cover as a marketing display (back-perspective view)

Figure 3:
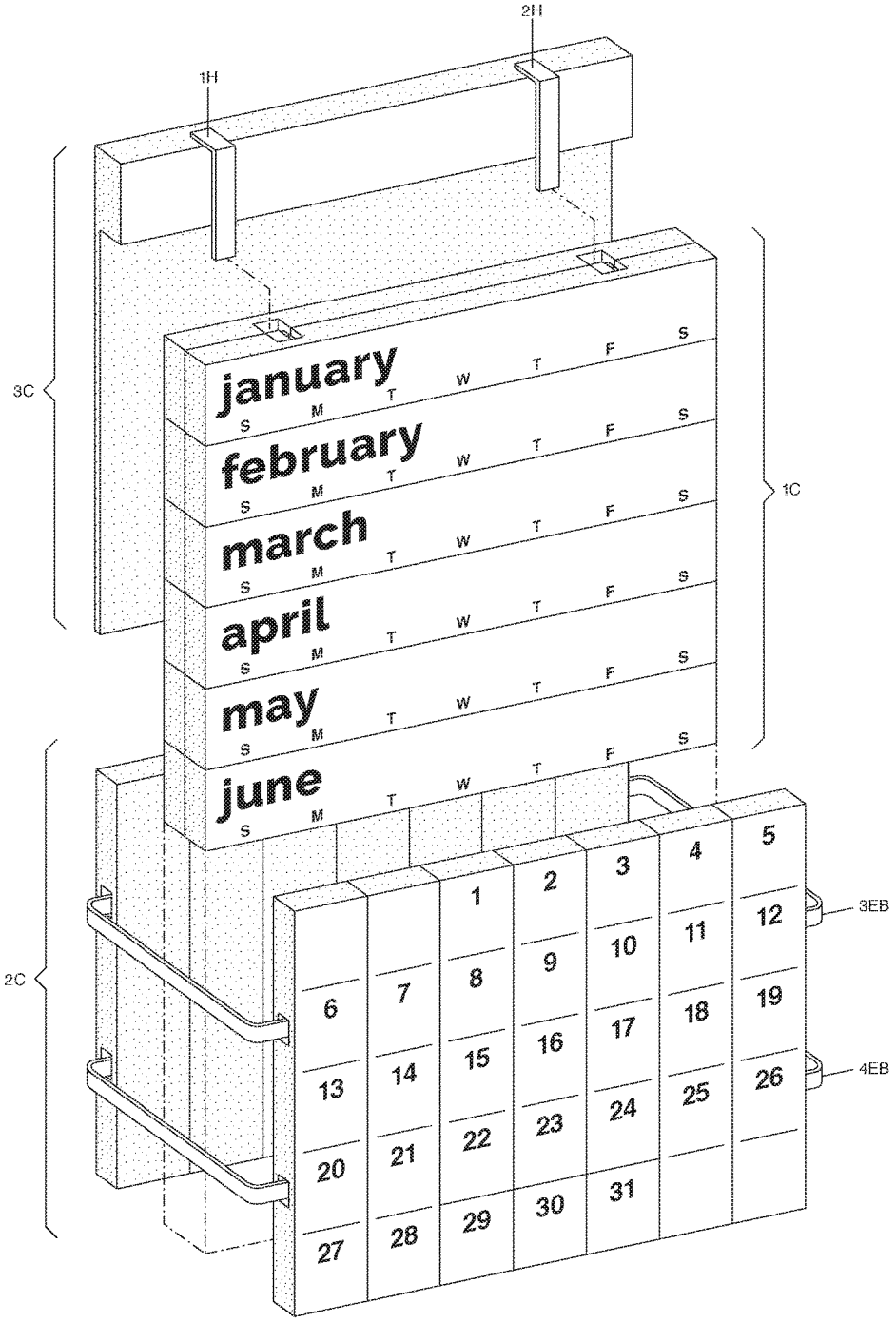

FIG. 3: Calendar assembled with the 3 components (exploded front-perspective view)

Figure 4:
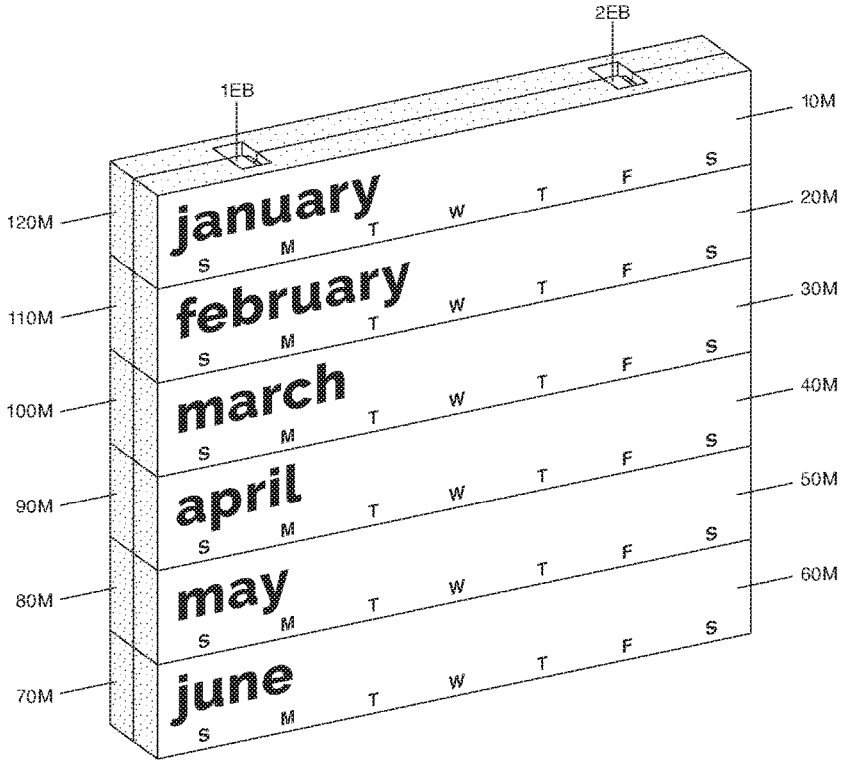

FIG. 4: Month/day display loop (front-perspective view)

Figure 5:
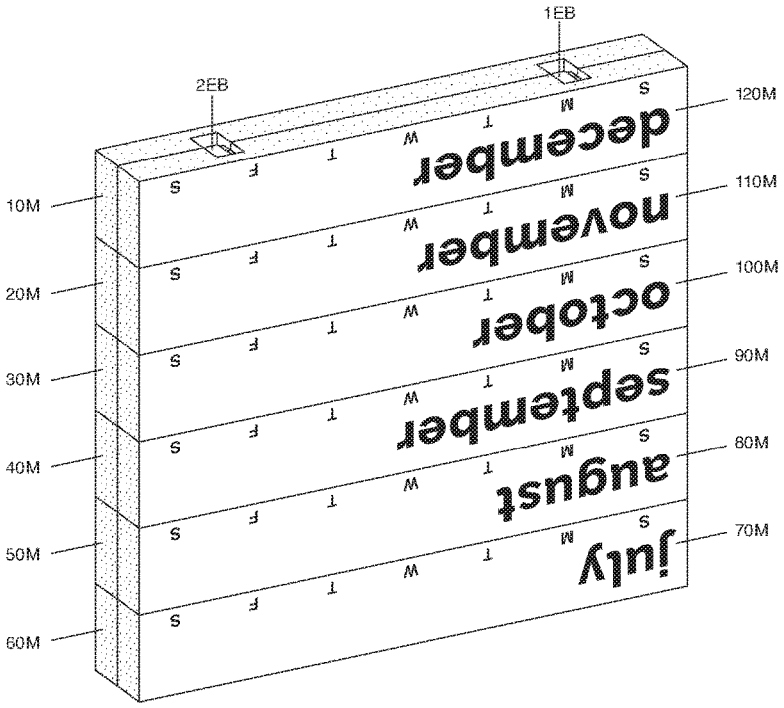

FIG. 5: Month/day display loop (back-perspective view)

Figure 6:
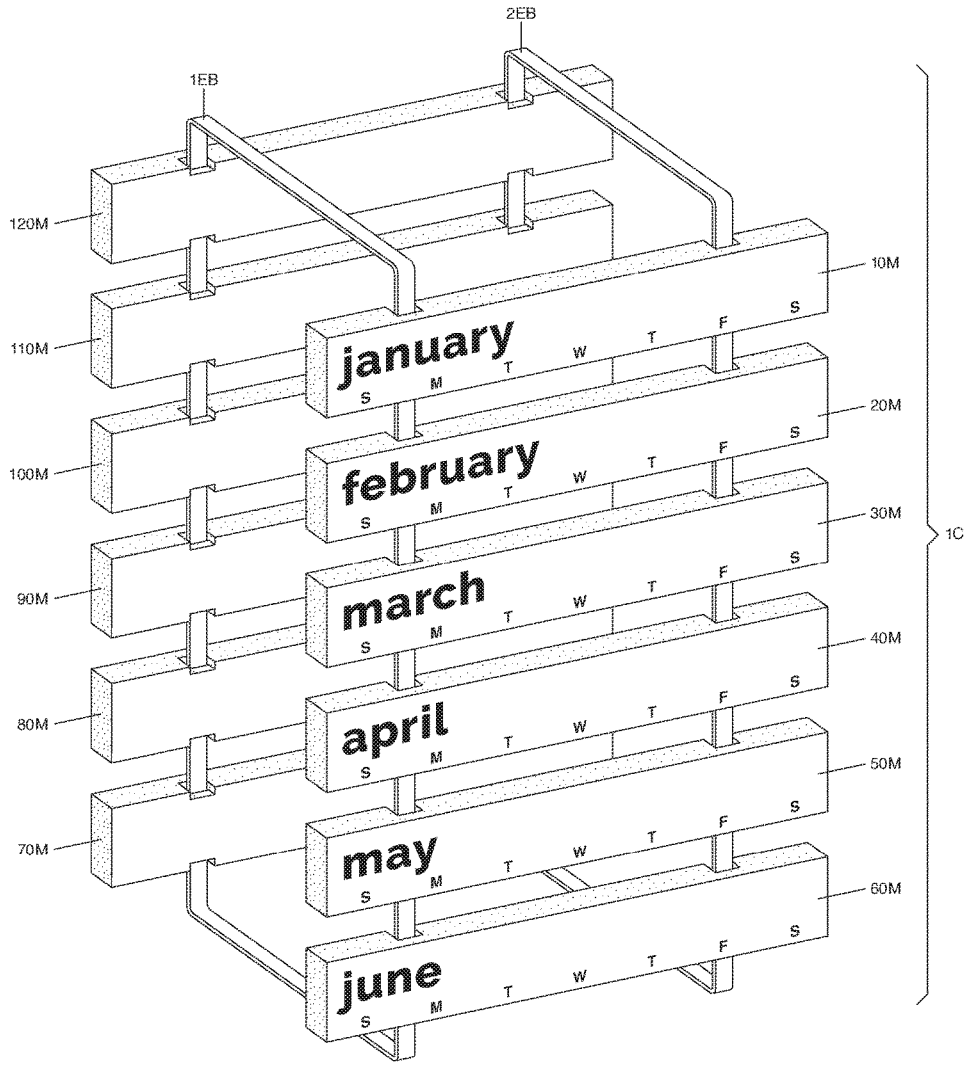

FIG. 6: Month/day display loop (exploded front-perspective view)

Figure 7:
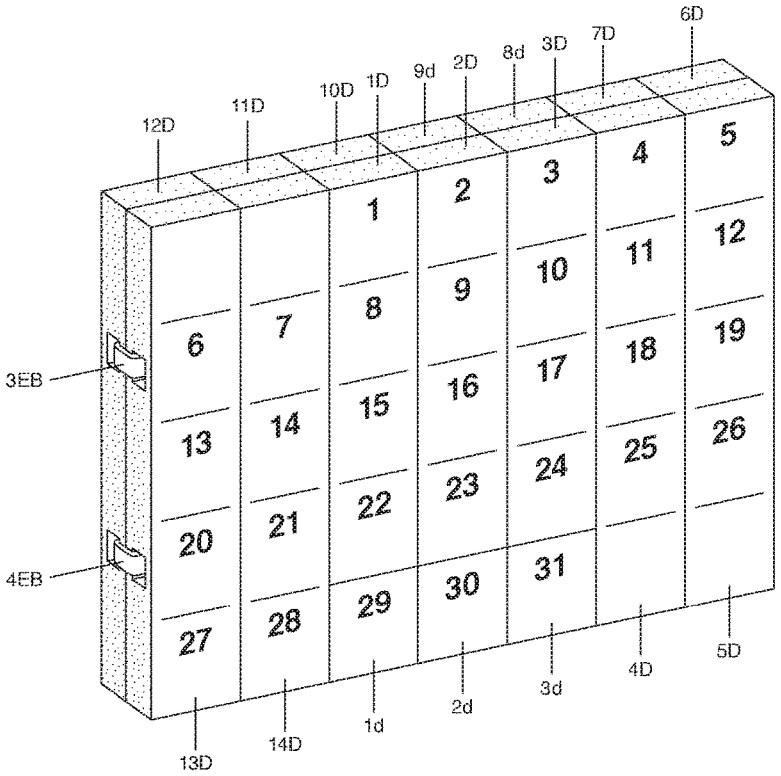

FIG. 7: Date display loop (front-perspective view)

Figure 8:
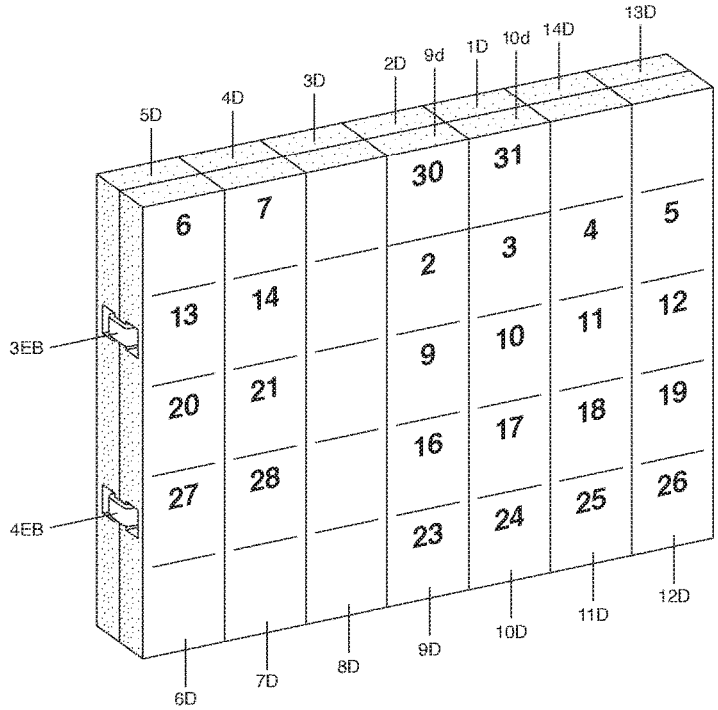

FIG. 8: Date display loop (back-perspective view)

Figure 9:
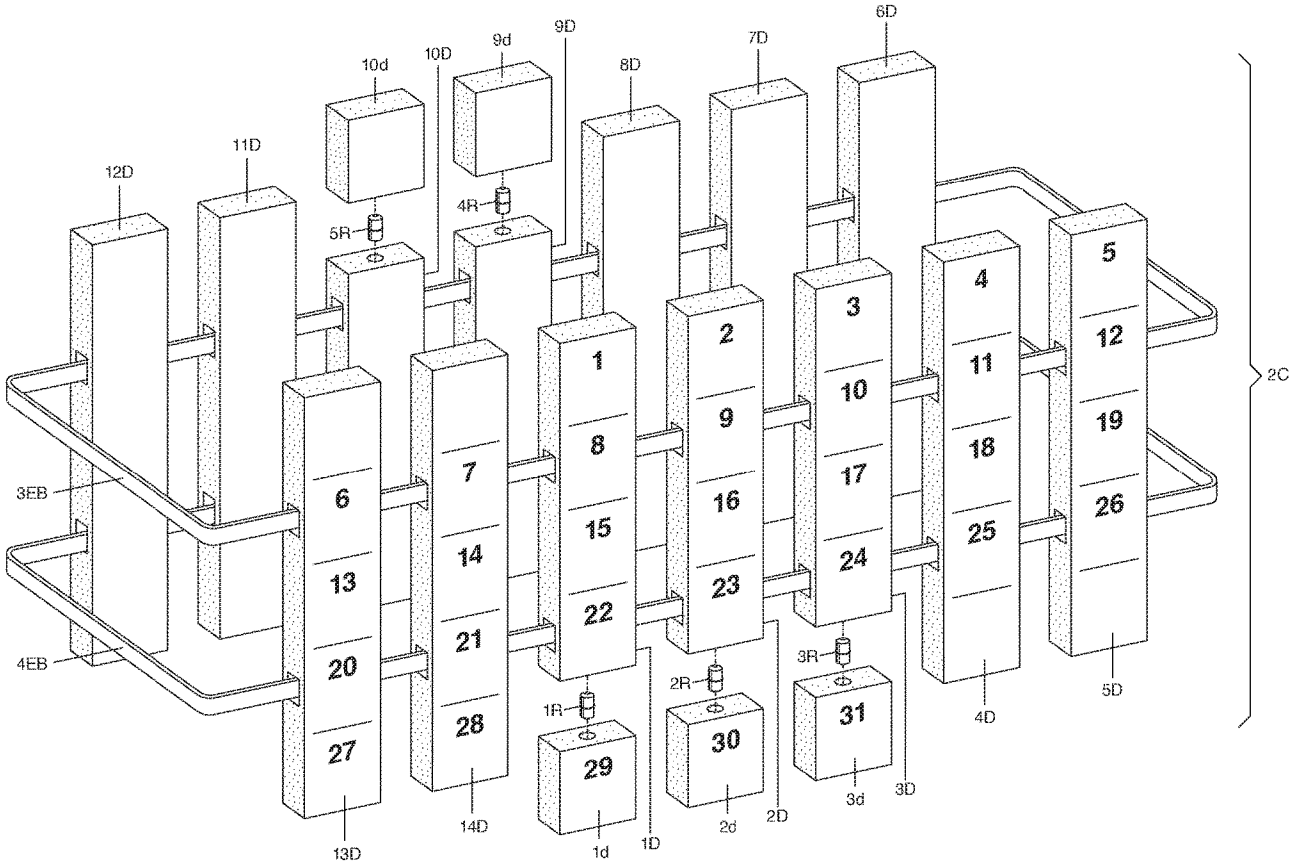

FIG. 9: Date display loop (exploded front-perspective view)

Figure 10:
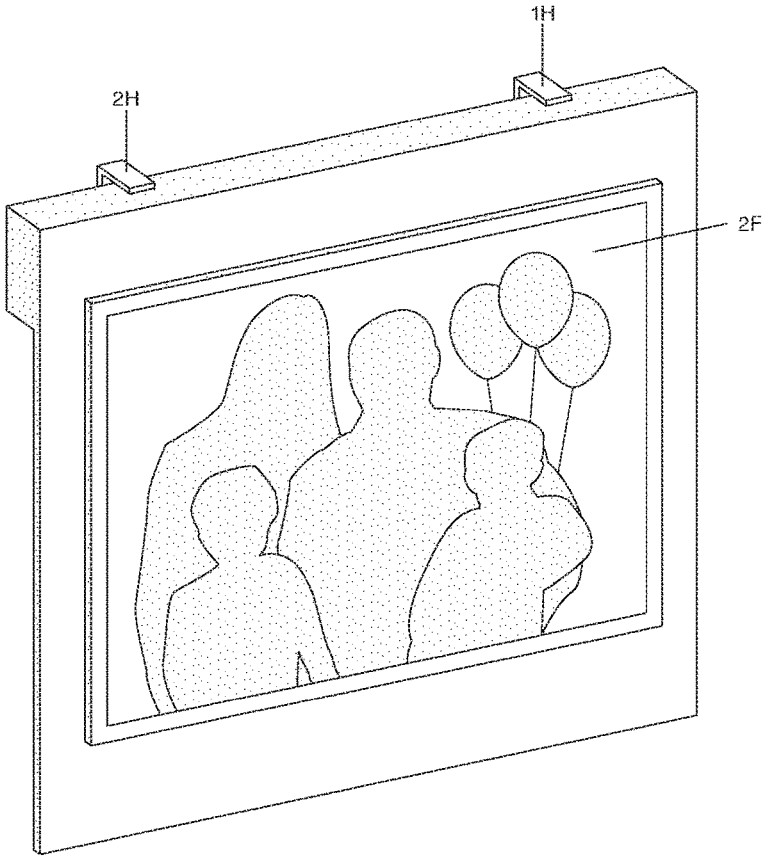

FIG. 10: Back cover as a photo frame (front-perspective view)

Figure 11:
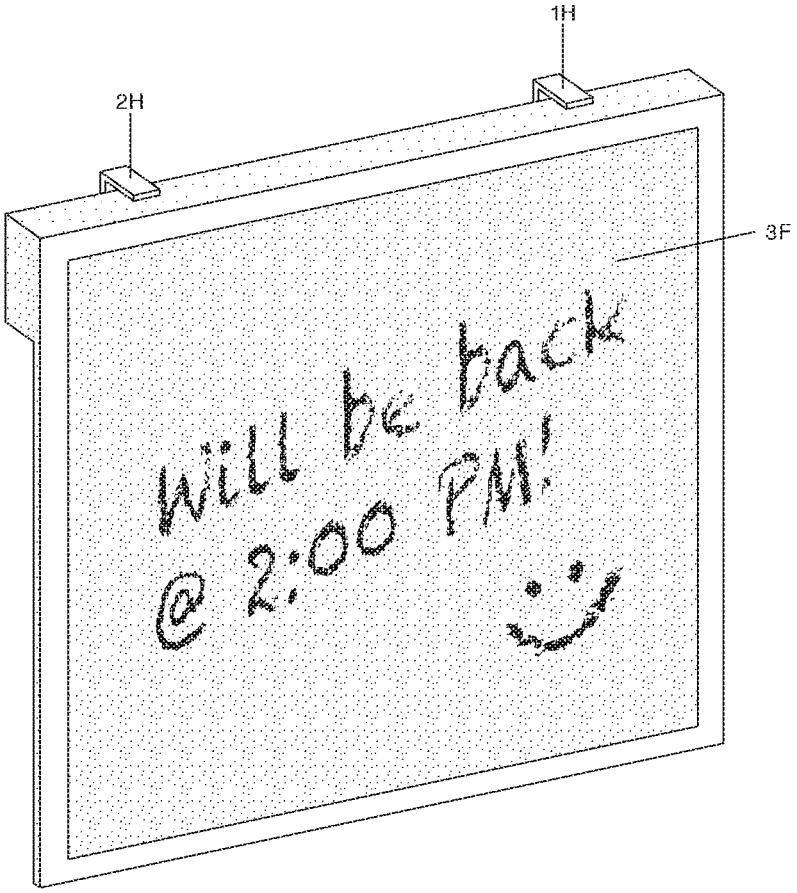

FIG. 11: Back cover as a chalkboard (front-perspective view)

Figure 12:
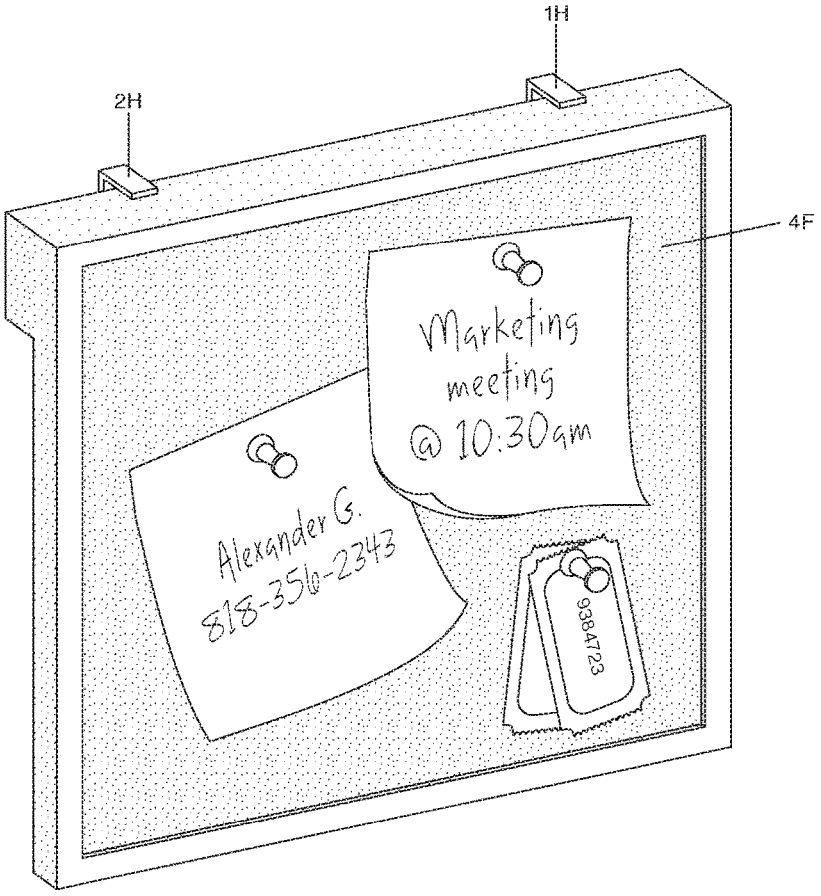

FIG. 12: Back as a corkboard (front-perspective view)

Figure 13:
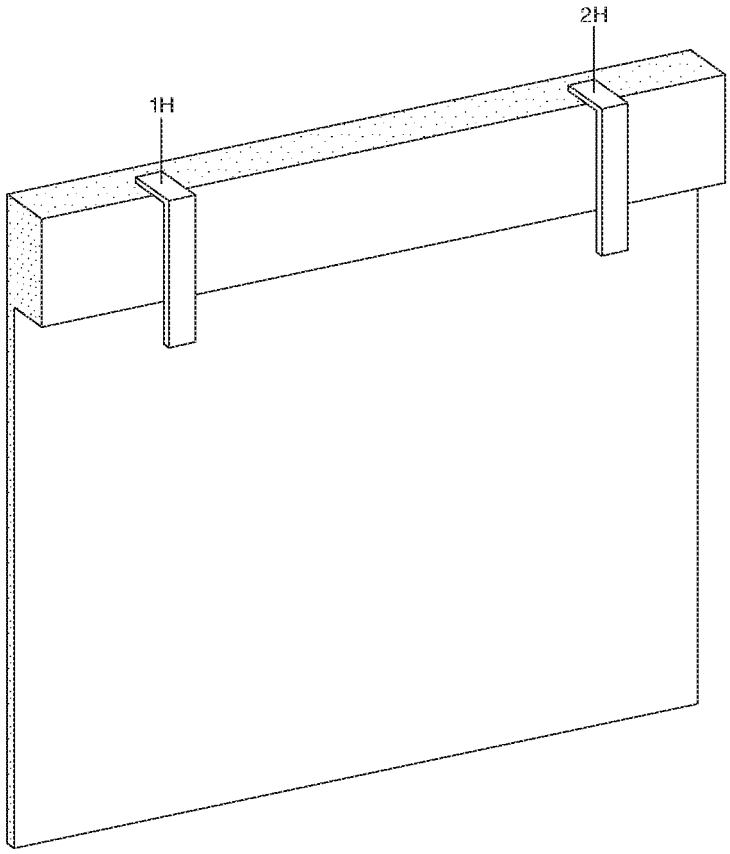

FIG. 13: Back cover (back-perspective view)

DRAWINGS—REFERENCE NUMERALS

The calendar components are numbered and use the suffix C (component):

1C: month/day display loop
2C: date display loop
3C; back cover

The month/day display loop horizontal pieces are numbered with multiples of 10, from 10 through 120, and the suffix M (month):

10M: Month of January
20M: Month of February
30M: Month of March
40M: Month of April
50M: Month of May
60M: Month of June
70M: Month of July
80M: Month of August
90M: Month of September
100M: Month of October
110M: Month of November
120M: Month of December The date display loop vertical pieces are numbered from 1 through 14, the suffix D (date) is used to indicate large and medium pieces and suffix d is used to indicate rotating small pieces. The 4 roto hinges are numbered and use the suffix R (roto hinge).

1D: Dates 1, 8, 15 and 22 (medium)
1*d*: Date 29 (bottom, small)
1R: Roto hinge 1
2D: Dates 2, 9, 16 and 23 (medium)
2*d*: Date 30 (bottom, small)
2R: Roto hinge 2
3D: Dates 3, 10, 17 and 24 (medium)
3*d*: Date 31 (bottom, small)
3R: Roto hinge 3
4D: Dates 4, 11, 18, 25 and null (large)
5D: Dates 5, 12, 19, 26 and null (large)
6D: Dates 6, 13, 20, 27 and null (large)
7D: Dates 7, 14, 21, 28 and null (large)
8D: Null (large)
9D: Dates 2, 9, 16 and 23 (medium)
9*d*: Date 30 (top, small)

4R: Roto hinge 4

10D: Date 3, 10, 17 and 24 (medium)

10*d*: Date 31 (top, small)

5R: Roto hinge 5

11D: Dates null, 4, 11, 18 and 25 (large)

12D: Dates null, 5, 12, 19 and 26 (large)

13D: Dates null, 6, 13, 20 and 27 (large)

14D: Dates null, 7, 14, 21 and 28 (large)

The elastic bands are numbered and use the suffix EB (elastic band):

1EB: Left vertical elastic band of month/day display loop

2EB: Right vertical elastic band of month/day display loop

3EB: Top horizontal elastic band of date display loop

4EB: Bottom horizontal elastic band of date display loop

The pieces of the back cover are numbered and use the suffixes H (hook), F (function):

1H: Left hook

2H: Right hook

1F: Front panel of the back cover as marketing display

2F: Front panel of the back cover as photo frame

3F: Front panel of the back cover as chalkboard

4F: Front panel of the back cover as corkboard

DETAILED DESCRIPTIONS

The overall appearance of the calendar assembled with the 3 components (1C, 2C and 3C) is shown in FIGS. 1, 2 and 3, corresponding to the front view, back view, and exploded front view, respectively. Said components are then detailed as follows: FIGS. 4, 5 and 6 are dedicated to the 12-piece month/day display loop (1C); FIGS. 7, 8 and 9 are dedicated to the date display loop (2C); and FIGS. 10, 11, 12 and 13 are dedicated to the back cover (3C). Although the subsequent description contains specifications of the present invention, they should not be used as limiting the scope of the invention, but as providing illustrations of some preferred components.

The total front surface of the assembled calendar, as seen in FIG. 1, displays pertinent information, namely: month name, days of the week initials, and all needed dates of the month. These elements are arranged in a common calendar fashion: name of the month on the top, followed bellow by the days of the week initials horizontally arranged, and finally the dates of the month arranged in a 7×5 grid. Most users will be familiar with this information layout already, which simplifies its manipulation. Although this general layout should remain unchanged, the font type, size, color, and overall calendar material and color can be customized to better suit personal or commercial purposes. FIG. 2 shows the back of the assembled calendar, which mainly displays the front panel of the back cover with its first proposed function as a marketing display. FIG. 3 illustrates the way in which the 3 components are assembled together: the date display loop (2C) is expanded so that the month/day display loop (1C) can be inserted, and the back cover is attached behind, by vertically inserting the hooks (1H and 2H) in the same vertical holes that bear the vertical elastic bands 1EB and 2EB.

The month/day display loop (1C) consists of 12 horizontal pieces shaped as rectangular prisms (10M through 120M) mainly shown in FIGS. 4, 5 and 6. All pieces have vertical holes that bear vertical elastic bands (1EB and 2EB) that bind them together consecutively, which gives component 1C flexibility to rotate and stability to stand still. Additionally, they prevent the many individual pieces from being easily misplaced and possibly lost. All pieces have the month name with a prominent font size on top, and the days of the week initials bellow it, evenly and horizontally arranged in a smaller font size. In FIG. 4, the front of the first 6 months' pieces appear fully visible; namely, 10M, 20M, 30M, 40M, 50M and 60M corresponding to January, February, March, April, May and June, respectively. FIG. 5 displays the back-perspective view of component 1C, displaying the following 6 months' pieces; namely, 70M, 80M, 90M, 100M, 110M, and 120M corresponding to July, August, September, October, November and December, respectively. In FIG. 5, the pieces appear up-side-down purposely, because component 1C loops around along the horizontal axis. For a better understanding of the construction of the month/day display loop (1C), FIG. 6 displays its exploded front-perspective view. In this figure, the path followed through the vertical holes of the pieces by the vertical elastic bands (1EB and 2EB) reveals more clearly the overall loop-like form of component 1C.

The date display loop (2C) is detailed in FIGS. 7, 8 and 9. This component comprises pieces shaped as vertical rectangular prisms and are of 3 kinds: large (5 cells), medium (4 cells) and small (1 cell). Its large and medium pieces (1D through 14D) are attached together using horizontal elastic bands (3EB and 4EB), providing it with the same flexibility and stability as the month/day display loop (1C), also allowing it to expand and embrace said component 1C. All the date display loop pieces display numbers corresponding to the dates of the month. By horizontally shifting its pieces, component 2C can display the 7 possible date layouts for a month, meaning that the first date of the month (piece 1D) can appear under any of the 7 days of the week. The small pieces (1*d*, 2*d*, 3*d*, 9*d*, 10*d*) are attached to the medium pieces via roto hinges (1R, 2R, 3R, 4R and 5R) that allow the small pieces to rotate freely. The small pieces display a number (29, 30 or 31) on one side, and are blank on the opposite side. This way, in the case of non-31-day months, these specific numbers can be hidden by rotating the pieces 180 degrees. When the date display loop (2C) is flattened (FIG. 7), the front pieces (in this example, 1D, 1*d*, 2D, 2*d*, 3D, 3*d*, 4D, 5D, 13D and 14D) form columns that display the information in a common calendar fashion: numbers are arranged in a 7×5 grid (7 columns by 5 rows), which are horizontally sequenced until the seventh column, resuming the sequence on the first column of the next row. The back side of the date display loop (FIG. 8), however displaying an analogous arrangement of numbers in some areas, does not reveal appropriate information, because the numbers on the pieces (in this example 6D, 7D, 8D, 9D, 9*d*, 10D, 10*d*, 11D, and 12D) do not form the calendar-like sequence described before. It is worth noting that piece 8D was purposely left blank, so that it is never displayed on the front of the calendar and piece 1D is always displayed on the front side of it, allowing the first day of the month to always appear on the top row of the calendar. FIG. 9 shows the exploded front-perspective view of the date display loop (2C) for a better understanding of the construction of this component. The loop-like form of component 2C and the rotation of pieces 1*d*, 2*d*, 3*d*, 9*d* and 10*d* can also be better understood in FIG. 9.

The function of the back cover is to enhance the appeal and functionality of the back of the other two assembled calendar components (see FIGS. 2, 10, 11, 12 and 13). The back cover (3C) consists of a front panel and 2 upper hooks (1H and 2H) which are vertically inserted in the same vertical holes that bear the vertical elastic bands 1EB and 2EB in component 1C. There are many possible functions that the back cover's front panel can perform, although, only four of them are presented in this document (1F, 2F, 3F and 4F). The first one is a marketing display (1F in FIG. 2) where marketing-related imagery such as a logotype, text or photos can be displayed; the second function (2F in FIG. 10) is a photo frame; the third function (3F in FIG. 11) is a chalkboard; and the fourth function (4F in FIG. 12) is a corkboard. Other possible functions could include combinations of those mentioned above, or other relevant functions.

To assemble the calendar, the user can use a different calendar as a reference to the correct layout of the desired month. The pieces of the month/day display loop (1C) are shifted vertically, in order to select the desired month by positioning it on the top front side of the component. Then, the pieces of the date display loop (2C) are shifted horizontally, in order to select the correct layout of the dates of the desired month. The first day of the month (piece 1D) should align with the corresponding day of the week initial, displayed on component 1C. The rotating small pieces (1*d*, 2*d*, 3*d*, 9*d* and 10*d*) are set according to the number of days of the desired month, by displaying the number or rotating the piece 180 degrees, in order to hide the number. The date display loop is expanded by creating a separation between the front 7 pieces and the back 7 pieces. The month/day display loop (1C) is then vertically introduced until it reaches the bottom of the date display loop (2C), leaving visible only the top piece of the desired month. Finally, the back cover (3C) is attached by inserting its two hooks (1H and 2H) in the same vertical holes that bear the vertical elastic bands 1EB and 2EB in component 1C. As previously mentioned, all the elastic bands (1EB, 2EB, 3EB, and 4EB) provide components 1C and 2C with flexibility in opposite directions, so that when these components are assembled together, the elastic bands provide the calendar with structural stability.

CONCLUSION AND VARIATIONS

The reader will find that the present invention displays substantial improvements in the design and usage of a perpetual month display calendar due to the interaction between its components and the user experience. The specifications described above should not be taken as limiting the scope of the invention but as merely providing illustrations of some of the preferred characteristics. Therefore, many other variations are possible within the scope of the invention. The invention can be manufactured using different materials such as wood, plastic, acrylic, etc. The width and height of the pieces can be altered as well, maintaining the relationship between them. Namely, the flattened date display loop (2C) should have the same horizontal length as the month/day display loop (1C); and the date display loop should have the same height as the bottom 5 pieces of the flattened component 1C. The depth of the aforementioned pieces can be enlarged or reduced. Design-wise, the font, size, color and weight could be customized according to the personal or commercial needs, and the text can be translated to multiple languages. Finally, the back cover (3C) can be designed to perform different functions or just stay blank.

What it is claimed is:

1. A perpetual month display calendar consisting of:

a month/day display loop, comprising 12 horizontal pieces shaped as rectangular prisms, characterized in that they contain 2 vertical holes that bear 2 vertical elastic bands that bind the pieces together forming a flexible and expandable loop; and that the pieces display, on the upper front area, the name of a month, and on the front lower area, the days of the week initials horizontally aligned and equidistant from each other;

a date display loop, into which said month/day display loop is inserted, comprising a plurality of vertical pieces characterized in that they are shaped as rectangular prisms; that consist of 9 large pieces that display 5 cells on the front side, 5 medium pieces that display 4 cells on the front side, and 5 small pieces that display 1 cell on the front side and are blank on the back side; that said large and medium pieces contain 2 horizontal holes that bear 2 horizontal elastic bands that bind them together; and that the small pieces are attached to the medium pieces on the top or bottom, using a means that allows the small pieces to rotate freely, in order to hide or expose the numbers displayed on them; that each display loop piece contains cells that either display a number or are blank; that one large piece is left blank and is positioned opposed to the medium piece displaying the first date of the month; that when the date display loop is flattened, the arrangement of the 7 front pieces displays a layout of numbers arranged in a 7×5 grid (7 columns by 5 rows), which are horizontally sequenced until the seventh column, resuming the sequence on the first column of the next row; and that said arrangement can be configured to form the 7 possible month layouts by shifting the pieces horizontally, namely, having the first date of the month matching any of the 7 days of the week;

and a back cover, attached to the other assembled components, comprising 2 upper hooks that are inserted in the 2 vertical holes that bear the vertical elastic bands of the month/day display loop, and a front panel that can perform one or more of the following functions: a blank flat surface, a marketing display for business-related imagery and/or text, a photo frame, a chalkboard, and/or a corkboard.

2. The perpetual calendar of claim 1, wherein the flattened month/day display loop, the flattened date display loop and the back cover have the same horizontal length, the date display loop has the same height as the bottom 5 pieces of the month/day display loop, and the back cover has the same height as the month/day display loop.

3. A method for setting the perpetual month display calendar of claim 1 comprising:

a. setting the month/day display loop by shifting its pieces vertically, and positioning the desired month on the top front of said component;

b. setting the date display loop by shifting its pieces horizontally, positioning seven of them on the front according to the desired month layout without displaying the one large piece left blank on the front, and aligning the first day of the month with the corresponding day of the week initial displayed on the month/day display loop;

c. hiding or displaying the dates 29, 30 and/or 31 by rotating their correspondent pieces 180 degrees, based on the number of days of the correspondent month;

d. vertically inserting the month/day display loop into the date display loop until it reaches the bottom and only the top piece is visible;

e. assembling the back cover by inserting the upper hooks inside the vertical holes that bear the month/day display loop vertical elastic bands.

* * * * *